US005163184A

United States Patent [19]

Reardon

[11] Patent Number: 5,163,184

[45] Date of Patent: Nov. 17, 1992

[54] EXPANDED WAISTBAND STRUCTURE FOR GARMENTS

[76] Inventor: John Reardon, 81 Barber Ave., Shrewsbury Twp., N.J. 07724

[21] Appl. No.: 778,468

[22] Filed: Oct. 16, 1991

[51] Int. Cl.[5] ..... A41D 1/06

[52] U.S. Cl. ..... 2/237; 2/227; 2/236; 2/79; 2/80; 2/218; 2/219

[58] Field of Search ..... 2/237, 79, 80, 218, 2/219, 220, 221, 227, 236

[56] References Cited

U.S. PATENT DOCUMENTS

| | | | |
|---|---|---|---|
| 1,084,968 | 1/1914 | Sablove | 2/221 |
| 1,858,201 | 5/1932 | Kimmel | 2/227 |
| 2,281,872 | 5/1942 | Donnelly | 2/237 |
| 2,434,714 | 1/1948 | Newcombe | 2/237 |
| 3,806,953 | 4/1974 | Kalil | 2/227 |
| 4,068,321 | 1/1978 | Chayer | 2/237 |
| 4,649,574 | 3/1987 | Nichels | 2/237 |
| 4,683,595 | 8/1987 | Cash | 2/221 |
| 4,803,740 | 2/1989 | Dawson | 2/221 |

FOREIGN PATENT DOCUMENTS

| | | | |
|---|---|---|---|
| 1013502 | 7/1977 | Canada | 2/237 |
| 1415738 | 9/1965 | France | 2/237 |
| 2233951 | 2/1975 | France | 2/237 |

*Primary Examiner*—Werner H. Schroeder
*Assistant Examiner*—Gloria Hale
*Attorney, Agent, or Firm*—Arthur L. Plevy

[57] ABSTRACT

An expanded waistband device that is affixed to a garment, worn about the waist, that has a selectively closeable seam such as a zipper or the like. A flap of material, held in place by mechanical fasteners, is used to span a seam that cannot be closed due to the physique of a wearer. The flap of material adds material to the waistband of the garment, expanding the size of the garment, allowing it to be comfortably worn. The expanded waistband device can be retrofitted onto undersized clothes and manufactured as part of new clothes to provide a custom fit to people with large abdominal regions.

20 Claims, 4 Drawing Sheets

EXPANDED WAISTBAND STRUCTURE FOR GARMENTS

FIELD OF THE INVENTION

The present invention relates to an expanded waistband structure for garments that is fastened about the waist and, more particularly, to such waistband structures that expand the waistband of garments, allowing the garments to fit about the rounded abdomen of an overweight or pregnant wearer.

BACKGROUND OF THE INVENTION

People come in a limitless variety of shapes and sizes. However, most clothing manufacturers do not manufacture a limitless variety of clothing sizes. In order to reduce manufacturing cost and increase productivity, most clothing manufacturers design clothes made to fit certain standard sizes and shapes. People who do not share the same physical parameters as the clothing manufacturers' standards are forced to buy clothing that may fit in one area, yet do not fit in another.

Compounding the frustration that people have with manufactured clothes is the fact that people often change shape before the life of their clothes expires. The change in a person's shape, due to diet, aging, pregnancy, or the like, makes people discard the clothes that once did fit properly and search for new clothing that better fit their new physique.

The most common physical attribute of a person that differs from the standards of the clothing industry is the waistline. It is also the waistline that is most likely to vary in size during a person's life. Consequently, it is often the waistline of a garment that does not fit a person's physique. Most commonly, a person's waistline is too large for a given standard size. In such a situation, the wearer would buy the next larger waist size, although the fit of the garment across the rest of the body may be oversized. Obviously, this problem is most prevalent with people who have waistlines that are unproportionally large when compared to their overall physique. Such people may have to purchase garments two to three sizes larger than is appropriate for their physique, just to find a proper sized waistband.

Fitting clothes to people having large or changing waistlines is not a new problem. Over the years, many types of apparel structures have been created that allow a waistline to be expanded to the size of its wearer. The most common approach to this problem is through the creation of elastic or otherwise resilient waistband. Some early examples of elastic waistbands are exemplified in U.S. Pat. Nos. 188,940 to Packscher, issued Mar. 27, 1877 and 360,979 to White, issued Apr. 12, 1887. Elastic waistbands are not appropriate for all styles of clothing and elastic waistbands cannot be easily added to existing clothing. Consequently, elastic waistbands offer only limited relief to people having rounded abdomens.

To avoid the appearance of an elastic waistband, removable elastic supports have been created within garments that are not visible, such as with U.S. Pat. No. 2,099,738 to Simpsom, issued Nov. 16, 1937. More typical in today's styles, to avoid elastic, is the use of the adjustably buttoned or snapped waistline. In such garments, the size of the waistline is determined by the positioning of overlapping sections of the waistline. Such garments are commonly used as maternity wear and are exemplified in U.S. Pat. No. 1,998,865 to Kekete, issued Apr. 23, 1935. Such specialty waistlines are specially manufactured and cannot be retrofitted onto existing clothing. Additionally, such expandable waistlines acted to merely increase the diameter of the waistline, and do not taper to fit the contours of a rounded abdomen.

It is, therefore, an object of the present invention to create an expanded waistband structure that is designed into new garments or retrofitted onto existing garments, allowing the waistline of a garment to be expanded and form-fit around contours of a wearer with a rounded abdomen.

SUMMARY OF THE INVENTION

The present invention relates to an extended waistline device for garments that are worn about the waist. Often, due to changes in weight, garments such as pants, shorts, skirts and the like, no longer fit around the person's waist. However, the garment may fit well over the person's buttocks and legs. The present invention extends the waistband of the garment so that old garments can again be worn without the necessity of purchasing larger garments that may have a fitted waistline but are oversized across the remainder of a wearer's physique. The present invention includes a flap of material that is the same as, or compliments, the material of the undersized garment. The material flap, using mechanical fasteners, is affixed to the garment across the area of a selectively closable seam, such as a zipper, or the like. The seam can then be left open so that the material flap covers the revealed area. The material flap holds the open seam together and provides the extra material needed so that the garment can fit across the abdomen of the wearer. The material flap is tapered and formed so as not to buckle as it forms about the rounded contours of the wearer's waistline, making the flap appear as an original part to the worn garment. Similarly, the present invention can be manufactured as part of original garments, allowing people with rounded abdomens to purchase form-fitting clothes.

BRIEF DESCRIPTION OF THE FIGURES

The above objects and further features and advantages of the invention are described in detail below in conjunction with the drawings, of which.

DETAILED DESCRIPTION OF THE FIGURES

Figure 1:
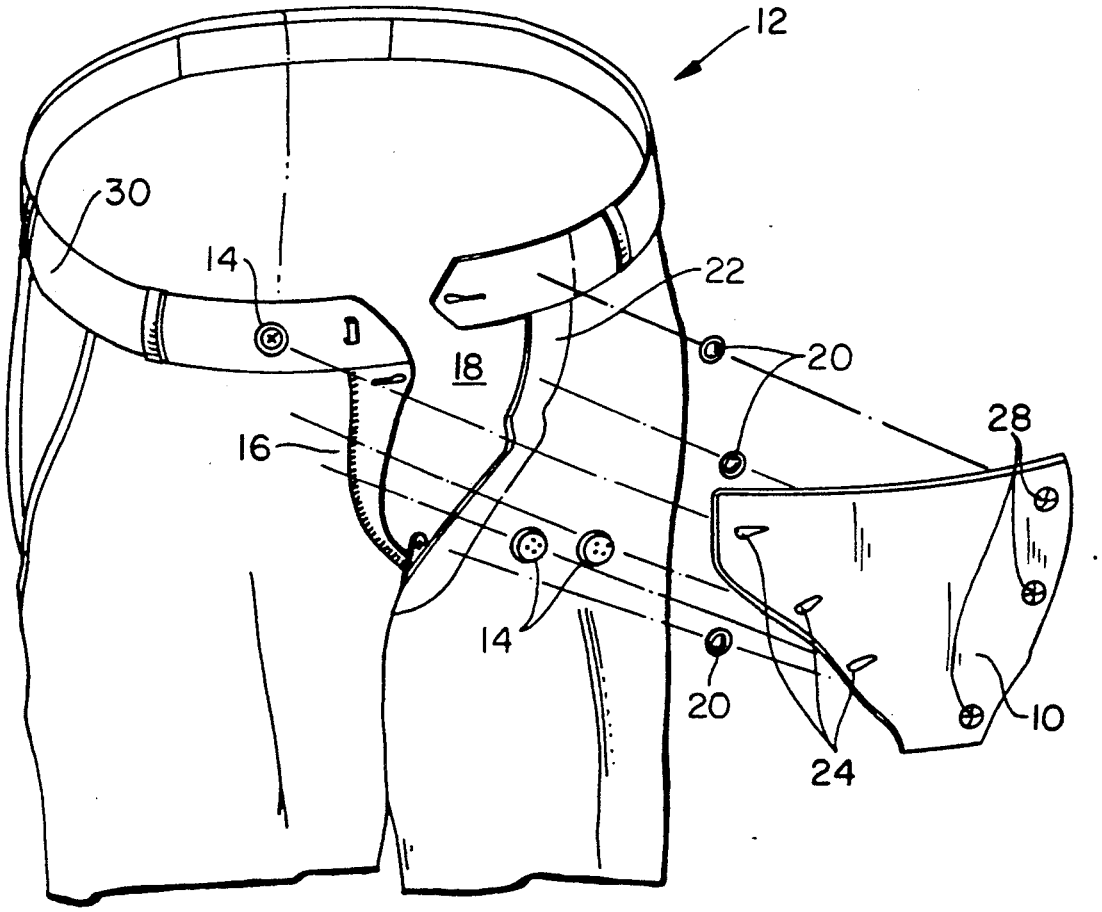
FIG. 1 is an exploded perspective view of the present invention shown in conjunction with a pair of pants.
Figure 2:
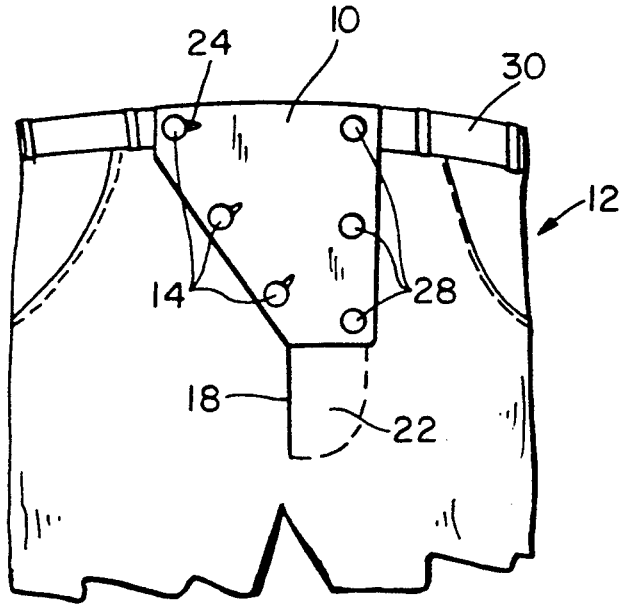
FIG. 2 is a front view of the present invention attached to a pair of pants.

Referring to FIGS. 1 and 2, one embodiment of the present invention is shown having a flap of material 10 formed in a texture and color that is similar to, or compliments, the material of a pair of pants 12. Buttons 14 are affixed to the pants 12, adjacent to one edge 16 of a closeable seam 18. The base segment 20 of snap fixtures are affixed to the pants 12, adjacent to the opposite edge of the closeable seam 18 over the fly 22. Buttonholes 24 are formed through the flap of material 10 at positions corresponding to the positioning of the buttons 14 on the pants 12. Similarly, the head segments 28 of snap fixtures are attached to the flap of material 10 at positions corresponding to the location of the snap bases 20.

If a person who is wearing the pants 12 has a waist that is larger than the waistband 30 of the pants 12, the person may be unable to fasten the waistband 30 in the manner to which it was designed. In such a circumstance, the closeable seam 18 of the pants may only be able to be partially closed. By attaching the flap of material 10 over the closeable seam 18 of the pants 12, the open gap in the waistband 30 and the portion of the unclosed closeable seam 18 are covered, allowing the pants 12 to be worn.

It should be understood that although both buttons 14 and snap fasteners are shown, any one or combination of mechanical fastening means can be used.

Figure 3:
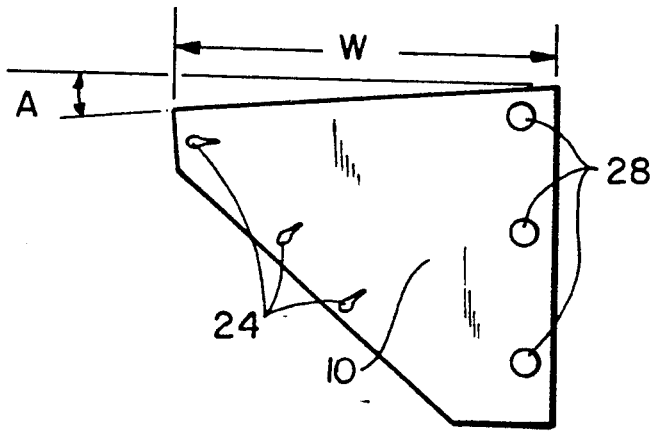
FIG. 3 is a front view of the present invention.

Referring to FIG. 3 in conjunction with FIGS. 1 and 2, the specifics of the material flap 10 are detailed. The material flap 10 tapers, having its widest length W positioned to span the gap in waistband 30 caused by the unfastened closeable seam 18 of a pair of pants 12. The length W of the material flap 10 is dependent upon how large of a gap exists in the closeable seam 18 of waistband 30. The length W of the material flap 10 may be manufactured for certain standard sizes, so that people of varying needs can purchase the correctly proportioned material flap 10. For example, material flaps with the length of two inches may be manufactured for people who have small gaps in their waistbands 30, four inches may be medium, six inches for large, etc. The larger sizes may require more buttons 14 or other fasteners, than do the smaller sizes to ensure secure fits.

The size of the material flap 10 through which the buttonholes 24 pass tapers inwardly. The taper avoids excessive buckling of the lower flap area since the material flap 10 is being fit over rounded surface. Similarly, the top of the material flap 10, having length W, tapers by an angle A away from the horizontal. The taper angle A prevents the buckling of the material as it follows the contours of a rounded abdomen. Typically, the taper angle A ranges between 10 and 15 degrees.

Figure 4:
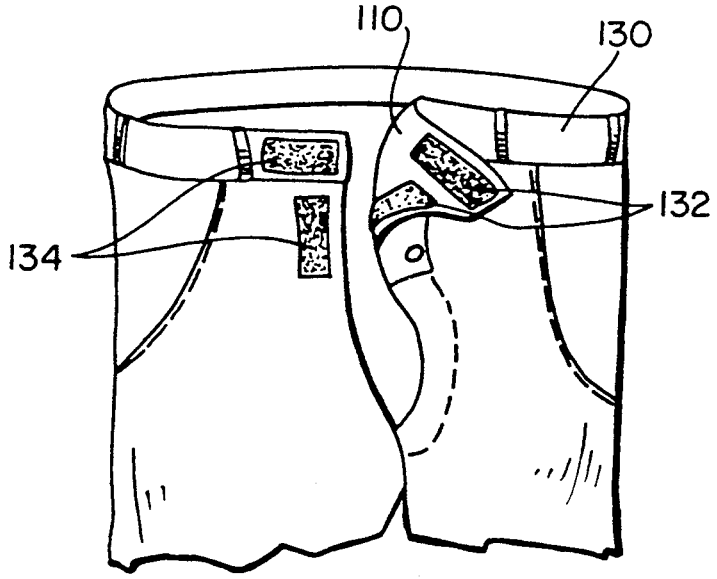
FIG. 4 is a front view of an alternative embodiment of the present invention attached to a pair of pants.

Referring to FIG. 4, an alternative embodiment is shown, wherein the button and buttonholes of the previous embodiment have been replaced with microhook patches 132 and microhoop patches 134, such as Velcro TM. The microhook 132 and microhoop 134 patches give the material flap 110 a degree of adjustability. Thus, the changes in a person's waistline, day to day, before and after meals, etc., can be comfortably adjusted for by overlapping the microhook 132 and microhoop 134 patches by varying amounts. The varying amount of overlap controls the overall size of the waistband 130.

Figure 5:
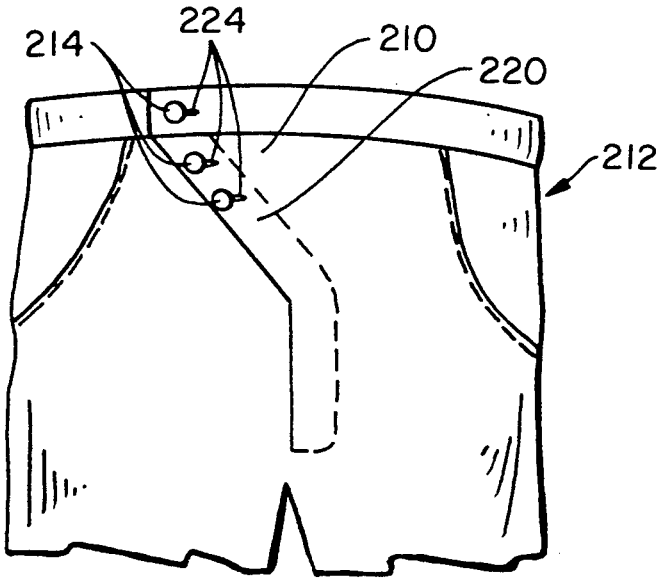
FIG. 5 is the front view of another alternative embodiment of the present invention integrally formed as part of a pair of pants.
Figure 6:
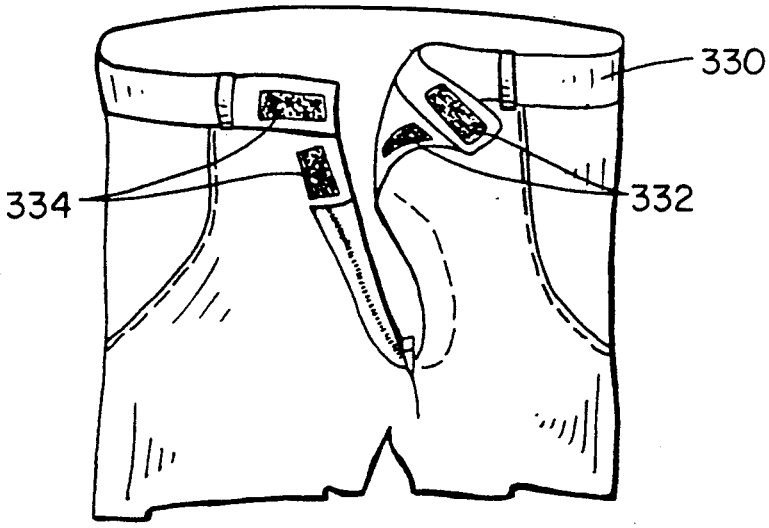
FIG. 6 is the front view of yet another alternative embodiment of the present invention integrally formed as part of a pair of pants.

Referring now to FIGS. 5 and 6, two embodiments of the present invention are shown as integrally formed with a pair of pants. Referring first to FIG. 5, the material flap 210 is created as part of the fly 222 of the pants 212. Buttons 214 are attached to the pants 212 and correspond in position to buttonholes 224 positioned along the tapered edge of the flap 210. The flap 210, although integral with the pants 212, still has the fly taper and waistband taper as described in the earlier embodiments.

FIG. 6 shows a variation of the embodiment of FIG. 5, wherein the buttons 214 and buttonholes 224, shown in FIG. 5, have been replaced with microhook patches 332 and microhoop patches 334. The microhook 332 and microhoop 334 patches give the flap 310 an adjustability of position to the waistband 330 unobtainable from preset buttons.

Figure 7:
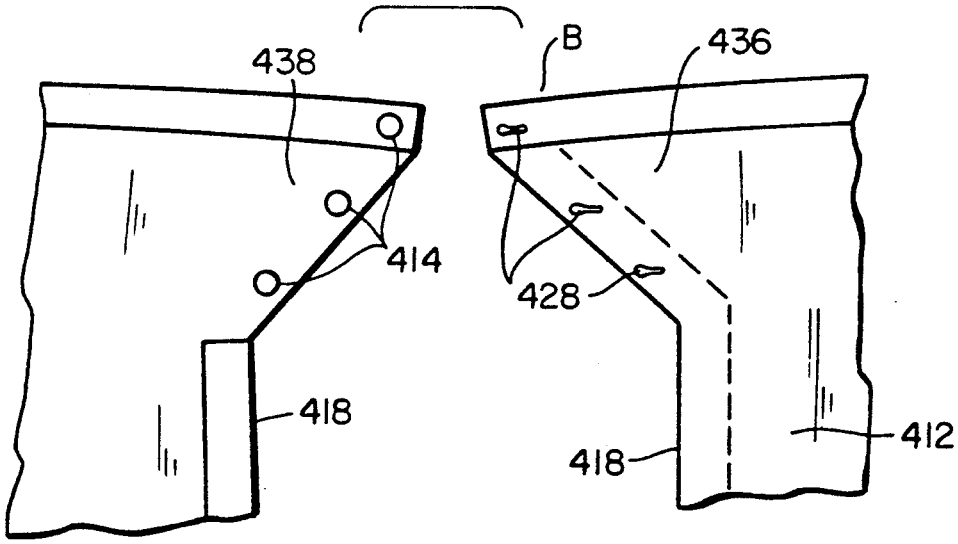
FIG. 7 is a front fragmented view of still yet another alternative embodiment of the present invention integrally formed as part of a pair of pants.

Referring to FIG. 7, yet another embodiment of the present invention is shown. In this embodiment, two flaps of material 436, 438 are present, each extending from one edge of the closeable seam 418. Each flap 436, 438 is tapered from top to bottom and also tapers across its length along angle B to the horizontal. Typically, the taper angle B ranges between 10 and 15 degrees. The flaps 436, 438 have correspondingly positioned buttons 414 and buttonholes 428 along the edge of the closeable seam 418. This embodiment prevents the buckling of material and keeps the line of the closeable seam 418 straight on the pants 412.

It should be understood that the embodiments described herein are merely exemplary and that a person skilled in the art may make variations and modifications without departing from the spirit and scope of the invention. For example, the snap fasteners, button fasteners and Velcro TM fasteners of any described embodiment are interchangeable among the embodiments. Similarly, any other known material fastening device can be substituted. Although all described embodiments relate to pants, it should be understood that the present invention can be used with any garment, such as shorts, skirts or the like that are fastened around the waist, and the closeable seam of such garments need not be formed on the front of the garment. All such variations and modifications are intended to be included within the scope of the invention as defined in the appended claims.

I claim:

1. A waistband extension device for use with a garment fastened about a user's waist having a waistband originating and terminating at a selectively closable seam, said garment having an inner surface positioned against said user and an outer surface opposite said inner surface, wherein said seam is at least partially open and forms an exposed area defined by said seam when said waist is larger than said waistband, said device including:

a material member for covering said exposed area and said seam when said seam is at least partially open; and a fastening means for fastening said material member to said outer surface over said exposed area and said seam thereby concealing said seam and said exposed area.

2. The device of claim 1, wherein said material member is shaped to conform to the periphery of said seam when said seam is open.

3. The device of claim 2, wherein said material member is formed so as to conform around a segment of a rounded abdomen without buckling.

4. The device of claim 3, wherein said material member is made of the same material as said garment.

5. The device of claim 3, wherein said material member is the same color as the material of said garment.

6. The device of claim 3, wherein fastening means includes at least one button.

7. The device of claim 6, wherein said material member has at least one buttonhole formed therethrough, corresponding to each said button.

8. The device of claim 7, wherein fastening means includes at least one metal snap.

9. The device of claim 8, wherein a portion of each said metal snap is permanently affixed to said material member.

10. The device of claim 3, wherein said fastening means includes corresponding patches of microhoop and microhook structures.

11. The device of claim 3, wherein said material member is shaped substantially as a right triangle having a substantially vertical edge, a substantially horizontal edge, and a hypotenuse, said triangle having its acute angles cut off, said flap of material having said fastening means positioned thereon along its hypotenuse and substantially vertical edge.

12. The device of claim 11, wherein, the angle between the substantially vertical and horizontal edges is between 75 degrees and 80 degrees.

13. A garment fastened about the waist, comprising:

a tapered abdominal region beginning at a waistband and traveling downwardly substantially toward a crotch;

an open seam, having two opposing edges, dividing at least part of said abdominal region from said waistband downward, one edge of said seam including a tapered flap beginning at said waistband and extending from said seam, said tapered flap providing the needed material for said abdominal region as said abdominal region expands from the bottom of said seam toward said waistband, wherein said waistband is angled downwardly toward said seam at a predetermined angle from horizontal; and a fastening means positioned along said opposing edges of said seam allowing said seam to be selectively closed.

14. The garment of claim 13, wherein said predetermined angle is between 10 degrees and 15 degrees from the horizontal.

15. The garment of claim 14, wherein said fastening means includes buttons.

16. The garment of claim 14, wherein said fastening means includes patches of microhook and microhoop structures.

17. A garment, fastened about the waist, comprising:

a tapered abdominal region beginning at a waistband and traveling downwardly substantially toward a crotch;

an open seam, having two opposing edges, separating adjacent sections of said abdominal region from said waistband downward, each opposing edge of said seam including a tapered flap extending therefrom, each said tapered flap providing the needed material for said abdominal region as said abdominal region expands from the bottom of said seam toward said waistband wherein said waistband of each of said adjacent sections is angled downwardly toward said seam at a predetermined angle from horizontal; and a fastening means positioned along the opposing edges of each said tapered flap, allowing said seam to be selectively closed.

18. The garment of claim 17, wherein said predetermined angle is between 10 degrees and 15 degrees from the horizontal.

19. The garment of claim 17, wherein said fastening means includes buttons affixed to one said tapered flap and buttonholes formed through the opposing said tapered flap corresponding to said buttons.

20. The garment of claim 17, wherein said fastening means includes opposing patches of microhook and microhoop structures.

* * * * *